US011667496B2

(12) United States Patent
Li et al.

(10) Patent No.: US 11,667,496 B2
(45) Date of Patent: Jun. 6, 2023

(54) ROLLER SYSTEM, ROLLER BRAKING DEVICE AND ELEVATOR SYSTEM

(71) Applicant: Otis Elevator Company, Farmington, CT (US)

(72) Inventors: BiChun Li, Shanghai (CN); ShenHong Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/391,768

(22) Filed: Aug. 2, 2021

(65) Prior Publication Data

US 2022/0135374 A1 May 5, 2022

(30) Foreign Application Priority Data

Nov. 2, 2020 (CN) ..... 202011200926.7

(51) Int. Cl.
*B66B 5/18* (2006.01)
*B66B 7/04* (2006.01)

(52) U.S. Cl.
CPC ..... *B66B 5/18* (2013.01); *B66B 7/042* (2013.01); *B66B 7/046* (2013.01)

(58) Field of Classification Search
CPC ..... B66B 5/18; B66B 7/042; B66B 7/046; F16D 49/00
See application file for complete search history.

(56) References Cited

U.S. PATENT DOCUMENTS 1,854,976 A * 4/1932 Brady ..... B66B 7/048 187/406
5,117,946 A * 6/1992 Traktovenko ..... B66B 7/046 187/410
5,632,358 A * 5/1997 Maeda ..... B66B 7/048 187/410
5,950,771 A * 9/1999 Ferrisi ..... B66B 7/048 187/409

(Continued)

FOREIGN PATENT DOCUMENTS

CH 684190 A5 7/1994
CN 2611342 Y 4/2004

(Continued)

OTHER PUBLICATIONS

JP2005126163 (machine translation) (Year: 2005).*
European Search Report for Application No. 21206077.6; dated Mar. 23, 2022; 7 Pages.

*Primary Examiner* — Michael A Riegelman
(74) *Attorney, Agent, or Firm* — Cantor Colburn LLP

(57) ABSTRACT

A roller system, a roller brake device and an elevator system. The roller brake device is used for the roller system. The elevator system includes the roller system. The roller system comprises a roller assembly and a roller brake device, the roller brake device includes: a body, the roller brake device is mounted to the roller assembly by the body; an actuation device mounted to the body; and a brake connected to the body in a pivotable manner, and the actuation device can move the brake from a rest position to a brake position, wherein the brake engages and brakes a roller in the roller assembly at the brake position, and the brake is disengaged from the roller at the rest position.

13 Claims, 3 Drawing Sheets

(56) References Cited

U.S. PATENT DOCUMENTS

| | | | | |
|---|---|---|---|---|
| 6,474,449 | B1 * | 11/2002 | Utsunomiya | B66B 7/042 187/292 |
| RE38,835 | E * | 10/2005 | Sevilleja | B66D 5/08 187/350 |
| 7,398,863 | B2 * | 7/2008 | Liebetrau | B66B 7/046 187/372 |
| 8,011,478 | B2 * | 9/2011 | Utsunomiya | B66B 7/042 187/292 |
| 8,869,946 | B2 * | 10/2014 | Okada | B66B 5/22 187/350 |
| 9,862,569 | B2 * | 1/2018 | Vlasov | B66B 5/00 |
| 10,214,382 | B2 * | 2/2019 | Wei | B66B 1/36 |
| 10,215,242 | B2 * | 2/2019 | Polack | B60T 13/748 |
| 2009/0032340 | A1 * | 2/2009 | Smith | B66B 7/042 188/73.31 |
| 2009/0308697 | A1 * | 12/2009 | Boschin | B66B 7/044 187/409 |
| 2011/0272223 | A1 * | 11/2011 | Drayer | B66B 5/044 188/65.1 |
| 2015/0291392 | A1 * | 10/2015 | Steiner | B66B 7/046 187/410 |
| 2017/0355563 | A1 * | 12/2017 | Zimmerli | B66B 7/08 |
| 2022/0135374 | A1 * | 5/2022 | Li | B66B 7/046 187/351 |

FOREIGN PATENT DOCUMENTS

| | | | |
|---|---|---|---|
| CN | 102897633 | A | 1/2013 |
| CN | 209352399 | U | 9/2019 |
| CN | 211169659 | U | 8/2020 |
| GB | 268296 | A | 9/1927 |
| JP | 2005126163 | A | 5/2005 |
| JP | 2006264852 | A | 10/2006 |
| JP | 2009208914 | A | 9/2009 |
| WO | 2020126445 | A1 | 6/2020 |

* cited by examiner

ROLLER SYSTEM, ROLLER BRAKING DEVICE AND ELEVATOR SYSTEM

FOREIGN PRIORITY

This application claims priority to Chinese Patent Application No. 202011200926.7, filed Nov. 2, 2020, and all the benefits accruing therefrom under 35 U.S.C. § 119, the contents of which in its entirety are herein incorporated by reference.

TECHNICAL FIELD

The present invention relates to the technical field of braking safety; in particular, the present invention relates to a roller system, and further relates to a roller brake device used for the roller system and an elevator system including the same.

BACKGROUND

Elevators are transportation equipment used for the transportation between different heights, in which various roller systems are usually employed, including but not limited to guide wheel systems, traction wheel systems and so on. These roller systems implement various functions by roller assemblies. For example, the guide wheel assemblies in the guide wheel system and the traction wheel assemblies in the traction wheel system can be used for guiding and traction of the car, respectively.

FIG. 1 is a schematic perspective view of an elevator system.

FIG. 2 is a schematic perspective view of a guide wheel system of an elevator system.

During operation, a traction machine 101 pulls a car 103 up and down by a traction rope or traction belt (such as steel rope/belt or carbon fiber rope/belt or other similar structures that can be used for car traction) 102 so as to transport passengers or goods. The elevator 100 has a guide system, including a guide rail 201 and the guide wheel system in FIG. 2. The guide wheel system includes a guide wheel assembly 202, the guide wheel assembly 202 is mounted on an elevator car frame 104 via its mounting base 204, in which each of the rollers 203 is adapted to engage and roll along each side of the guide rail 201 to achieve the guiding function to the car 103.

When the elevator stops at the landing 300, due to the deformation of the traction rope or traction belt 102, when passengers or goods enter into or exit the elevator, it will cause the obvious bounce of the traction rope or traction belt and the vibration of car 103. In order to alleviate or eliminate this kind of bounce and vibration, the guide wheel system in the prior art provides a roller brake device to inhibit the rotation of the guide wheel 203 after the elevator stops at the landing 300, thereby preventing the car 103 from moving along the guide rail 104, so that the foregoing bounce and vibration will not occur when the car 103 is loaded or unloaded.

SUMMARY

An object of one aspect of the present invention is to provide an improved roller system.

An object of another aspect of the present invention is to provide a roller brake device for the foregoing roller system.

An object of further aspect of the present invention is to provide an elevator system including the foregoing roller system.

In order to achieve the foregoing objects, one aspect of the present invention provides a roller system, wherein the roller system comprises a roller assembly and a roller brake device, the roller brake device includes: a body, the roller brake device is mounted to the roller assembly by the body; an actuation device mounted to the body; and a brake connected to the body in a pivotable manner, and the actuation device can move the brake from a rest position to a brake position, wherein the brake engages and brakes a roller in the roller assembly at the brake position, and the brake is disengaged from the roller at the rest position, and wherein, a part of the brake that is acted by the actuation device and a part of the brake that engages the roller are both located on the same side of the pivot shaft between the body and the brake.

Optionally, in the roller system as described above, the roller brake device further includes: a first biasing device, the first biasing device is disposed between the body and the brake, and biases the brake in a direction away from the roller.

Optionally, in the roller system as described above, the first biasing device is a coil spring connected between the body and the brake, or the first biasing device is a torsion spring placed on a pivot shaft between the brake and the body.

Optionally, in the roller system as described above, the brake has opposite first and second side surfaces, and the actuation device acts on the first side surface, the brake acts on the roller via the second side surface.

Optionally, in the roller system as described above, a part on the first side surface interacted with the actuation device is an inclined surface.

Optionally, in the roller system as described above, at the brake position, the axis of an actuation lever and the inclined surface are perpendicular to each other.

Optionally, in the roller system as described above, the actuation device includes an actuation lever connected to the body in a pivotable manner, and one end of the actuation lever is used to actuate the brake.

Optionally, in the roller system as described above, the actuation device includes an actuation lever connected to the body in a pivotable manner, and the one end of the actuation lever is provided with a rolling wheel, and the actuation lever actuates the brake via the rolling wheel.

Optionally, in the roller system as described above, a second biasing device is provided between the actuation lever and the body, and the second biasing device biases the actuation lever in a direction that causes the one end of the actuation lever away from the brake.

Optionally, in the roller system as described above, the second biasing device is a coil spring connected between the actuation lever and the body, or the second biasing device is a torsion spring placed on a pivot shaft between the actuation lever and the body.

Optionally, in the roller system as described above, the actuation lever connects a cable transmission mechanism driven by a motor or an electromagnetic solenoid.

Optionally, in the roller system as described above, the actuation lever connects a gear transmission mechanism driven by a motor.

In order to achieve the foregoing objects, another aspect of the present invention provides a roller brake device for the roller system according to any one of the foregoing aspects.

In order to achieve the foregoing objects, further aspect of the present invention provides an elevator system, which includes the roller system according to any one of the foregoing aspects, wherein: the roller system is a guide wheel system in the elevator system and the roller is a guide wheel in the guide wheel system; or the roller system is a traction wheel system in the elevator system and the roller is a traction wheel in the traction wheel system.

DESCRIPTION OF THE DRAWINGS

With reference to the drawings, the disclosure of the present invention will be more apparent. It should be understood that these drawings are only for illustrative purposes and are not intended to limit the scope of protection of the present invention. In the drawings.

DETAILED DESCRIPTION

Figure 1:
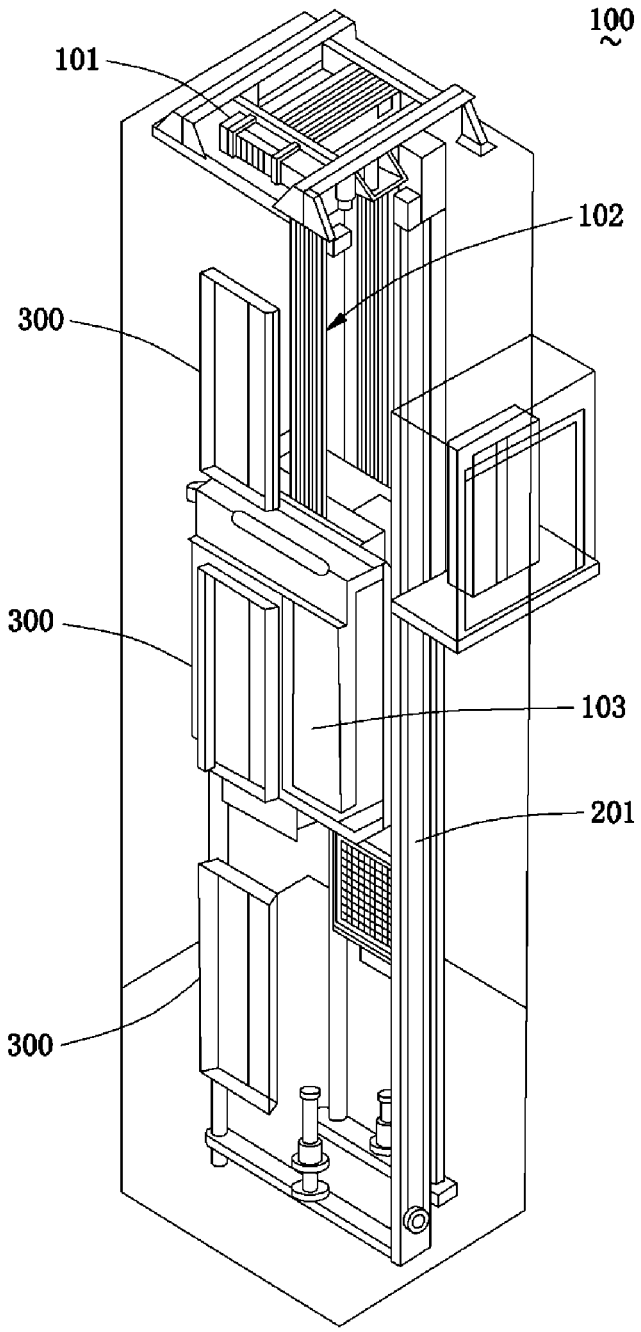
FIG. 1 is a schematic perspective view of an elevator system.
Figure 2:
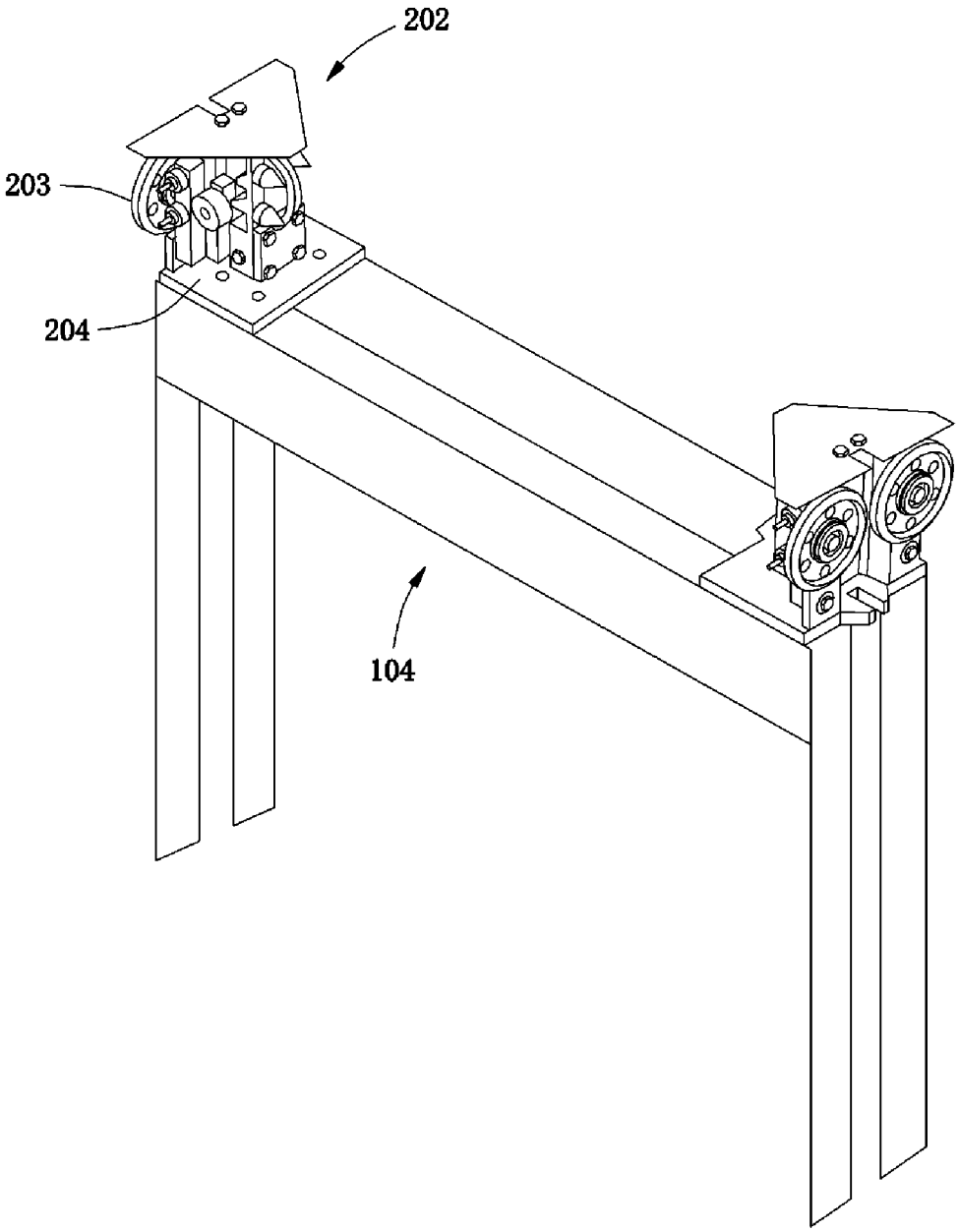
FIG. 2 is a schematic perspective view of a guide wheel system of the elevator system.

Specific embodiments of the present invention will be described in detail below with reference to the drawings. In the drawings, the same reference numerals indicate the same or corresponding technical features. It should be understood that the specific embodiments and the drawings are only exemplary descriptions of the technical solutions of the present invention, and should not be regarded as the entire of the present invention or as a restriction or limitation to the technical solutions of the present invention.

The orientation terms mentioned or possibly mentioned in the specification are defined relative to the structures shown in the drawings, they are relative concepts, so they may vary according to their different positions and state of use accordingly. Therefore, these or other orientation terms should not be interpreted as restrictive terms. In addition, the terms "first", "second" or similar expressions are only used for illustration and distinguishing purposes, and should not be understood as indicating or implying the relative importance of the corresponding components.

Figure 3:
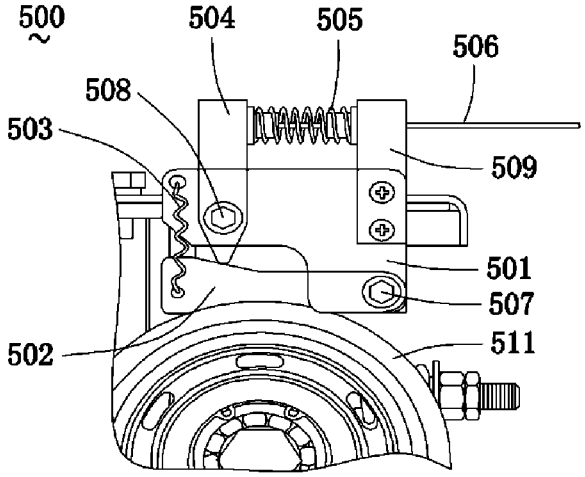
FIG. 3 schematically shows a partial side view of a roller system according to an embodiment of the present invention, wherein the roller is a guide wheel.

FIG. 3 schematically shows a partial side view of a roller system according to an embodiment of the present invention, wherein the roller is a guide wheel.

The roller system may include a roller assembly and a roller brake device. In FIG. 3, only the guide wheel is used as an example to schematically show the roller in the roller assembly. According to different embodiments, the roller assembly may be a guide wheel assembly in an elevator guide wheel system, a traction wheel assembly in a traction wheel system and so on, and the roller may be a guide wheel or a traction wheel. The roller assembly may also be other types of assemblies with rollers. The roller brake device provides a brake function for the roller in the corresponding roller assembly.

The roller assembly can be appropriately mounted to the car frame. For example, in the example of the guide wheel assembly, the guide wheel assembly can be mounted onto an elevator car frame by its mounting base. The guide wheel brake device can be mounted to the guide wheel assembly. For details, reference can be made to the following detailed description of the roller brake device.

As shown in FIG. 3, in this embodiment, a roller brake device 500 may include a body 501, a brake 502, a first coil spring 503, an actuation lever 504, a second coil spring 505, a cable 506 and so on. The FIG. 3 also shows a roller 511 of the roller assembly in the roller system.

In an optional embodiment, the body 501 may be the frame itself or an independent component fixed to the frame, the roller brake device is mounted to the roller assembly via the body, and the body is used for providing the positioning basis to the other components of the roller brake device. In order to facilitate the positioning of each component, additional support may also be provided on the body or an independent component fixed to the body, for example, the support 509 provided for the second coil spring 505 in the illustrated example. In the illustrated example, the brake 502 and the actuation lever 504 may be mounted to the body 501 via a pivot shaft 507 and a pivot shaft 508, respectively. In an optional embodiment, the actuation lever 504 may also adopt other mounting methods other than pivoting.

FIG. 3 also shows a roller 511 in the form of a guide wheel, which can be the guide wheel 203 in the elevator guide system. In other optional embodiments, the roller 511 may also be a traction wheel in an elevator traction system. It can be understood that the roller assembly can be mounted on the elevator car frame, and the roller brake device 500 can be mounted to the roller assembly via the body 501. Accordingly, the body 501 can be positioned relative to the roller 511.

In addition, it can also be seen from the FIG. 3 that the parts of the actuation lever 504 and the roller 511 acted on the brake 502 are both located on the same side of the pivot shaft 507 between the brake 502 and the body 501, that is, the brake 502 can be formed as a swing arm, which can be actuated and swung to engage and disengage the roller 511, so that the braking effect is more effective and more reliable. In order to make braking to be more effective, the brake 502 may have a circular arc shape matching with the roller 511 at the position where it interacts with the roller 511.

In the roller brake device 500, the brake 502 has a brake position and a rest position. At the brake position, the brake 502 engages and brakes the roller 511; at the rest position, the brake 502 is disengaged from the roller 511. The actuation lever 504 can move the brake 502 from the rest position to the brake position, and a reset device such as the first coil spring 503 is used to return the brake 502 from the brake position to the rest position.

By the roller brake device illustrated, when braking is carrying out, the cable 506 pulls the actuation lever 504 to pivot, so that one end of the actuation lever 504 slidingly fractionizes and pushes the brake 502 to cause the brake 502 engages and brakes the roller 511 to slow down or prevent the rotation of the roller 511. When the cable 506 is released, the actuation lever returns to the initial position where the brake 502 is not pushed, and the brake 502 returns to the position where it is disengaged from the roller 511.

According to this embodiment, at the brake position, the actuation lever 504, the brake 502 and the roller 511 provide a acting force between each other, and this acting force provides an extraordinary static pressure between the brake 502 and the roller 511, forming static friction.

In the prior art, the friction between the brake and the roller is insufficient, and this embodiment overcomes this problem. The braking force in the roller brake device 500 may not completely depend on the pulling force of the cable 506, but is not directly related to the pulling force of the cable 506 and the pulling force provided by the actuation lever 504 to the brake 502. When the actuation lever 504 makes the brake 502 enter the brake position, the dependence on the actuation device is relatively small, and it is easy to be adjusted and maintained at site, the product quality and the action are more reliable, and it will not produce relative sliding caused by reasons such as brakes loosing. In the illustrated embodiment, after entering the brake position, the internal force formed between the various components can be magnified many times compared with the braking force generated by the actuating mechanism directly or generated by the actuating mechanism by means of a lever.

The reset of the brake 502 is realized by the first coil spring 503. According to this embodiment, one end of the brake 502 is connected to the body 501 in a pivotable manner, and the other end of the brake 502 is connected to the body 501 by means of the first coil spring 503. Therefore, as mentioned above, when the brake 502 is driven by the actuation lever 504, it can pivot about the pivot shaft 507 toward the roller 511; when the actuation lever 504 is released, the brake 502 can pivot in the opposite direction under the pulling of the first coil spring 503, so that the brake 502 returns to the position where it is disengaged from the roller 511.

In different embodiments, the brake 502 can be in any suitable shape and made of any suitable material. For example but not limitation, it can be in the form of brake plates, brake pads or brake strips and so on. In an optional embodiment, the shape of the brake at the acting part may be the same as the radius of the roller such as the guide wheel, which can increase the friction force area with the surface of the roller.

In addition, although the brake 502 is connected to the body 201 at one end of the brake 502 in the illustrated example, in other alternative embodiments, as appropriate, the brake may also be connected to the body 201 at other parts such as middle part, as long as the acting part of the brake is formed as form of a pivotable swing arm.

It can also be seen from the FIG. 3 that the brake 502 may have opposite first and second side surfaces, and the actuation lever 504 acts on the first side surface, and the brake 502 acts on the roller 511 by means of the second side surface. In the illustrated embodiment, a part of the first side surface is exemplarily formed as an inclined surface, and the actuation lever can act on the inclined surface with sliding friction. Specifically, when the actuation lever 504 is driven to pivot, its end close to the inclined surface pushes on the inclined surface while swinging to the left, so that the brake 502 engages and brakes the roller 511. Under such circumference, the pushing force of the end of the actuation lever 504 acting perpendicularly on the brake 502 is directly provided by the pivot shaft, and the pushing force is much greater than the sliding friction force of the actuation lever 504 acting on the brake 502 in its swing direction, and stably acts on the brake 502.

In this case, at the brake position, the axis of the actuation lever 504 and the inclined surface on the brake 502 may be perpendicular to each other. Under such circumference, the actuation lever 504 and the brake 502 reach a relatively stable state, making the braking very reliable.

In an optional embodiment, a first torsion spring may be used to replace the first coil spring 503. In this case, the first torsion spring may be arranged at the pivot shaft 507 to bias the brake 502 in a direction away from the roller 511. In other embodiments, according to specific needs, other conventional biasing devices can also be used between the body and the brake to realize the function of resetting the brake 502, and the brake 502 is biased in the direction away from the roller 511. In the drawings, this direction is the clockwise direction of the brake 502 around the pivot shaft 507 between the body 201 and the brake 502. In the rest state of the roller brake device 500, the brake 502 is biased away from the roller 511 by the biasing device, so that the braking effect is not triggered.

A actuation lever 504 is connected to the body 501 in a pivotable manner. When the cable 506 is pulled, the actuation lever 504 rotates around its pivot shaft 508, so that the actuation lever 504 reaches a position where its end pushes the brake 502. When the cable 506 is released, the second coil spring 505 pulls the actuation lever 504 to return to the position where the brake 502 is not pushed. Likewise, in an optional embodiment, a second torsion spring may be used to replace the second coil spring 505. In this case, the second torsion spring may be disposed at the pivot shaft 508 to bias the actuation lever 504 toward the direction in which the brake 502 is released. In other embodiments, according to specific needs, other conventional biasing devices can also be used to realize the function of resetting the actuation lever 504.

According to the illustrated embodiment, the actuation lever 504, the second coil spring 505, the cable 506 and so on constitute an actuation device, which is mounted on the body 501 as a whole, and is adapted to overcome the biasing force of the first coil spring 503, pushing and actuating brake 502 to pivot. The actuation device can move the brake from the rest position to the brake position, wherein the brake engages and brakes the roller 511 in the brake position, and the brake is disengaged from the roller 511 in the rest position.

It should be pointed out that in other embodiments, one or both of the second coil spring 505 and the cable 506 can be replaced, and other devices are used to provide power to the actuation lever 504 to realize the actuation and release of the actuation lever 504.

For example, in different embodiments, an electromagnetic solenoid (not shown) can be used to actuate the cable 506, or a motor (such as a stepper motor or a rotating motor) can be used to actuate the cable 506, and then the cable 506 pulls the actuation lever 504 to rotate and push the brake 502 to act, for example, and stop before the actuation lever 504 reaches its end position. The state of the end position may be a state where the axis of the actuation lever 504 and the contacted inclined surface of the brake 502 are perpendicular to each other. Furthermore, the actuation lever 504 can be actuated by other transmission mechanisms such as a gear transmission mechanism driven by a motor; under such circumference, the resetting of the actuation lever 504 can also be realized by the driving mechanism, without the need for providing additional coil springs and so on.

Figure 4:
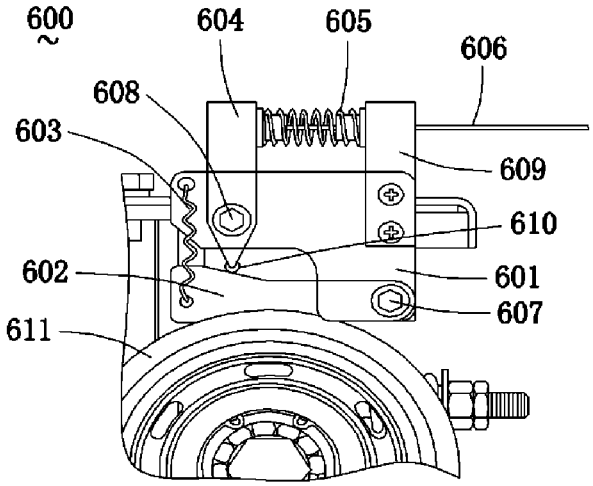
FIG. 4 schematically shows a partial side view of a roller system according to another embodiment of the present invention, wherein the roller is a guide wheel.

FIG. 4 schematically shows a partial side view of a roller system according to another embodiment of the present invention, wherein the roller is a guide wheel. Regarding the description of the roller brake device 600, the body 601, the brake 602, the first coil spring 603, the actuation lever 604, the second coil spring 605, the cable 606, the pivot shaft 607, the pivot shaft 608, the support 609 and the roller 611 in FIG. 4, reference can be made to the description of the roller brake device 500, the body 501, the brake 502, the first coil spring 503, the actuation lever 504, the second coil spring 505, the cable 506, the pivot shaft 507, the pivot shaft 508, the support 509 and the roller 511 in FIG. 3, and we will not repeat it here.

Compared with the embodiment in FIG. 3, the main difference of the embodiment in FIG. 4 is that a rolling wheel 610 is provided at the end of the actuation lever 604 near the brake 602, so that the end of the actuation lever 604 forms the rolling friction with the brake 602 be means of the rolling wheel 610. With this arrangement, under the condition that the same braking force can be generated, the driving force required to pivot the actuation lever 604 is smaller, and it is allowable to use for example lower cost electromagnetic actuators, motors, and gear transmission mechanisms.

Based on the examples in FIGS. 3 and 4 and the above description, it can be understood that the brakes 502, 602 may have a brake position and a rest position. At the brake position (as shown), the biasing force of the first coil springs 503 and 603 is overcome by the actuating force of the actuation levers 504 and 604, and the brakes 502 and 602 engage and brake the rollers 511 and 611. At the rest position (not shown), the biasing force of the first coil springs 503 and 603 is not overcome, and the brakes 502 and 602 are disengaged from the rollers 511 and 611.

Another aspect of the present invention also provides a roller brake device for the roller system of any of the foregoing embodiments. The specific arrangement of the roller brake device can be shown in FIGS. 3 and 4, and for details, reference can be made to the detailed description above in conjunction with the roller system, which may specifically include the roller and the roller brake device. Another aspect of the present invention also provides an improved elevator system.

In one case, the elevator system may include the roller system of any of the foregoing embodiments, wherein the roller system may be a guide wheel system in an elevator system, and the rollers 511 and 611 may be guide wheels 203 in a guide wheel system. In the case that the roller system is a guide wheel system of an elevator system, the bodies 501, 601 of the roller brake devices 500, 600 can be fixed to the frame 104 of the elevator car 103 or the mounting base 204 of the guide wheel assembly 202 so as to provide an mountation foundation for other parts of the roller brake devices 500 and 600, so that the roller brake devices 500 and 600 have a relatively fixed position relative to the elevator car 103 and the guide wheel assembly 202 in the guide system as a whole. The specific arrangement of the roller brake device can be shown in FIGS. 3 and 4, and for details, reference can be made to the detailed description above in conjunction with the roller system, which may specifically include the roller and the roller brake device.

And/or, in another case, the elevator system may include a roller system of any of the foregoing embodiments, wherein the roller system may be a traction wheel system in an elevator system and the rollers 511, 611 may be a traction wheel (not shown) in the traction wheel system. In this case, a large braking static friction and friction at a very low cost can be achieved at very low cost by locking the traction motor when it stops and releasing the traction motor when it operates.

The technical scope of the present invention is not limited to the content in the above description. Those skilled in the art can make various modifications and combinations of the above embodiments without departing from the technical idea of the present invention, and these modifications, and combinations should all fall within the scope of the present invention.

What is claimed is:

1. A roller system, characterized in that, the roller system comprises a roller assembly and a roller brake device, and the roller brake device includes:

a body, by which the roller brake device is mounted to the roller assembly;

an actuation device mounted to the body; and a brake connected to the body in a pivotable manner, and the actuation device can move the brake from a rest position to a brake position, wherein the brake engages and brakes a roller in the roller assembly at the brake position, and the brake is disengaged from the roller at the rest position, and wherein, a part of the brake acted by the actuation device and a part of the brake engaging the roller are both located on the same side of a pivot shaft between the body and the brake;

wherein the actuation device includes an actuation lever connected to the body in a pivotable manner, and one end of the actuation lever is used to actuate the brake.

2. The roller system according to claim 1, wherein the roller brake device further includes:

a first biasing device disposed between the body and the brake, and biasing the brake in a direction away from the roller.

3. The roller system according to claim 2, wherein the first biasing device is a coil spring connected between the body and the brake, or the first biasing device is a torsion spring placed on a pivot shaft between the brake and the body.

4. The roller system according to claim 1, wherein the brake has opposite first and second side surfaces, and the actuation device acts on the first side surface, the brake acts on the roller via the second side surface.

5. The roller system according to claim 4, wherein a part on the first side surface interacted with the actuation device is an inclined surface.

6. The roller system according to claim 5, wherein at the brake position, an axis of an actuation lever and the inclined surface are perpendicular to each other.

7. The roller system according to claim 1, wherein a second biasing device is provided between the actuation lever and the body, and the second biasing device biases the actuation lever in a direction causing the one end of the actuation lever away from the brake.

8. The roller system according to claim 7, wherein the second biasing device is a coil spring connected between the actuation lever and the body, or, the second biasing device is a torsion spring placed on a pivot shaft between the actuation lever and the body.

9. The roller system according to claim 1, wherein the actuation lever connects a cable transmission mechanism driven by a motor or an electromagnetic solenoid.

10. The roller system according to claim 1, wherein the actuation lever connects a gear transmission mechanism driven by a motor.

11. A roller brake device for the roller system according to claim 1.

12. An elevator system, characterized in that, the elevator system includes the roller system according to claim 1, wherein:

the roller system is a guide wheel system in the elevator system and the roller is a guide wheel in the guide wheel system; or the roller system is a traction wheel system in the elevator system and the roller is a traction wheel in the traction wheel system.

13. A roller system, characterized in that, the roller system comprises a roller assembly and a roller brake device, and the roller brake device includes:

a body, by which the roller brake device is mounted to the roller assembly;

an actuation device mounted to the body; and a brake connected to the body in a pivotable manner, and the actuation device can move the brake from a rest position to a brake position, wherein the brake engages and brakes a roller in the roller assembly at the brake position, and the brake is disengaged from the roller at the rest position, and wherein, a part of the brake acted by the actuation device and a part of the brake engaging the roller are both located on the same side of a pivot shaft between the body and the brake;

wherein the actuation device includes an actuation lever connected to the body in a pivotable manner, and one end of the actuation lever is provided with a rolling wheel, and the actuation lever actuates the brake via the rolling wheel.

* * * * *